US007665837B2

(12) United States Patent
Son

(10) Patent No.: US 7,665,837 B2
(45) Date of Patent: Feb. 23, 2010

(54) RECORDING MEDIUM DISCHARGE APPARATUS AND IMAGE FORMING APPARATUS HAVING THE SAME

(75) Inventor: Myung-bo Son, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 463 days.

(21) Appl. No.: 11/384,502

(22) Filed: Mar. 21, 2006

(65) Prior Publication Data

US 2007/0085892 A1 Apr. 19, 2007

(30) Foreign Application Priority Data

Oct. 13, 2005 (KR) ..... 10-2005-0096735

(51) Int. Cl.
*B41J 2/01* (2006.01)

(52) U.S. Cl. ..... 347/104; 347/101

(58) Field of Classification Search ..... 347/104, 347/101, 103, 16

See application file for complete search history.

(56) References Cited

U.S. PATENT DOCUMENTS 6,322,068 B1 * 11/2001 Iemura et al. ..... 271/177

FOREIGN PATENT DOCUMENTS

| | | |
|---|---|---|
| JP | P09-169463 | 6/1997 |
| JP | 2003-212378 | 7/2003 |
| JP | 2005-75493 | 3/2005 |
| JP | 2005-096965 | 4/2005 |

OTHER PUBLICATIONS

Office Action issued by Japanese Patent Office in Japanese Patent Application No. 2005-0096735 on Sep. 22, 2006.

* cited by examiner

*Primary Examiner*—Manish S Shah
(74) *Attorney, Agent, or Firm*—Staas & Halsey LLP

(57) ABSTRACT

A recording medium discharge apparatus includes a discharge pusher for discharging a recording medium; and a discharge tray in which the recording medium discharged through the discharge pusher is stacked. The discharge pusher is configured to be capable of conducting electric current, thereby eliminating the static electricity from the recording medium discharged to the discharge tray. For the electric conduction of the discharge pusher, the discharge pusher includes a conductive material. Alternately, an elastic member is made of a conductive material in such a way that a part of the elastic member is extended to a surface of the discharge pusher which comes into contact with the recording medium.

20 Claims, 5 Drawing Sheets

RECORDING MEDIUM DISCHARGE APPARATUS AND IMAGE FORMING APPARATUS HAVING THE SAME

CROSS-REFERENCE TO RELATED APPLICATION

This application claims the benefit of Korean Patent Application No. 2005-96735, filed Oct. 13, 2005 in the Korean Intellectual Property Office, the disclosure of which is incorporated herein by reference.

BACKGROUND OF THE INVENTION

1. Field of the Invention

Aspects of the present invention relate to a recording medium discharge apparatus and an image forming apparatus using the same, and in particular to a recording medium discharge apparatus adapted to efficiently eliminate static electricity of a recording medium discharged to a discharge tray and an image forming apparatus using the same.

2. Description of the Related Art

In an image forming apparatus, such as a copying machine and a printer, an anti-static device is often employed in order to eliminate static electricity from a recording medium electrified while being conveyed within the image forming apparatus. An example of an image forming apparatus provided with an anti-static device as described above is disclosed in Japanese unexamined patent publication No. 2003-212378 and in FIG. 1.

Referring to FIG. 1, in a paper loading tray 11, an anti-static device 19 is installed downstream of a paper-feeding roller 12. A paper end filler 16 of the anti-static device 19 is arranged to be freely rotated, and an anti-static brush 17 supported by a bracket 18 is rotated clockwise. Through this construction, when a recording medium P1 enters the device 19, the paper end filler 16 is pushed and rotated by the recording medium P1 so that the paper end filler 16 comes into contact with the anti-static brush 17.

FIG. 2 shows a document conveying device provided with another conventional anti-static device. Referring to FIG. 2, an anti-static mechanism 36 is provided in a document tray in a sheet document reading device of a document reversing type between a document setting tray 31 and a discharge stack tray 32. Through this construction, it is possible to prevent the repulsion/adhesion of the document caused by frictional static electricity produced as a document 32 is conveyed. The conveying device also includes an image sensor 38 and a contact glass 39. As described above in relation to FIGS. 1 and 2, various types of anti-static devices are provided in order to eliminate static electricity from a recording medium while being conveyed.

FIG. 3 shows an example provided with another conventional anti-static device. Referring to FIG. 3, a print head 51 for forming an image on a recording medium 53. A platen 55 is provided under the print head 51 so that a recording medium 53 to be formed with an image is seated on the platen 55. In addition, a feed roller 57 adjacent the platen 55 feeds the recording medium 53 by a predetermined distance. A discharge pusher 61 is provided at a side of the feed roller 57 so as to discharge the recording medium 53 to a discharge tray 59. The discharge pusher 61 is supported by a coil spring 63, so that the discharge pusher 61 is returned to its original position by the restoring force of the coil spring 63 after the discharge pusher 61 has discharged the recording medium 53.

In addition, in the entrance side of the discharge tray 59, there is additionally provided an anti-static brush 65. The anti-static brush 65 comes into contact with the recording medium 53, thereby eliminating static electricity from the recording medium 53. However, because the anti-static brush 65 is provided at the entrance side of the discharge tray 59, there is a problem in that static electricity produced by friction between a recording medium 53 and the discharge tray 59 or between the recording medium 53 and another recording medium already printed and laid on the discharge tray 59 cannot be eliminated, thereby causing poor stacking.

SUMMARY OF THE INVENTION

Aspects of the present invention provide a recording medium discharge apparatus with an improved in anti-static structure.

Other aspects of the present invention provide an image forming apparatus which uses the recording medium discharge apparatus.

According to an aspect of the present invention, a recording medium discharge apparatus includes a discharge pusher for discharging a recording medium; and a discharge tray in which the recording medium discharged through the discharge pusher is stacked, wherein the discharge pusher is configured to conduct electric current, thereby eliminating the static electricity from the recording medium discharged to the discharge tray.

According to an aspect of the present invention, the discharge pusher is formed from a conductive material.

According to an aspect of the present invention, the recording medium discharge apparatus further includes a conductive member additionally provided on a surface of the discharge pusher which comes into contact with the recording medium.

According to an aspect of the present invention, the discharge pusher is supported by a conductive spring connected so that the spring extends to the surface of the discharge pusher.

According to an aspect of the present invention, the spring is a coil spring.

According to another aspect of the present invention, there is provided an image forming apparatus comprises: a print head for forming a given image on a recording medium; a feed roller for feeding the recording medium a predetermined distance; a discharge pusher for discharging the recording medium with the formed image; and a discharge tray in which the recording medium discharged through the discharge pusher is stacked, wherein the discharge pusher conducts electric current, to eliminate the static electricity from the recording medium discharged to the discharge tray.

BRIEF DESCRIPTION OF THE DRAWINGS

The above and other aspects and/or features of the present invention will be more apparent and more readily appreciated from the description for certain embodiments of the present invention taken with reference to the accompanying drawings, in which.

DETAILED DESCRIPTION OF THE EMBODIMENTS

Figure 1:
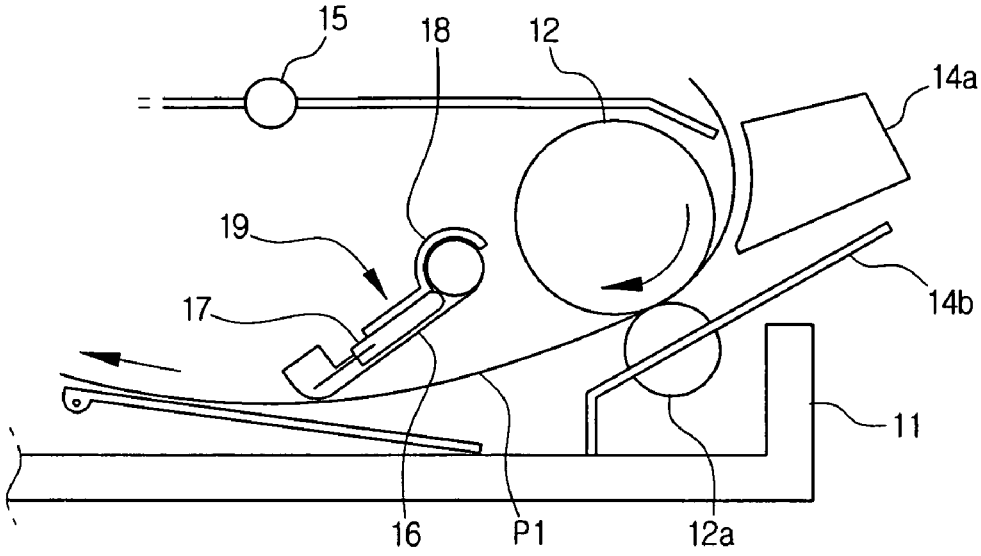
FIG. 1 (PRIOR ART)
FIG. 1 shows a construction of a conventional anti-static device.
Figure 2:
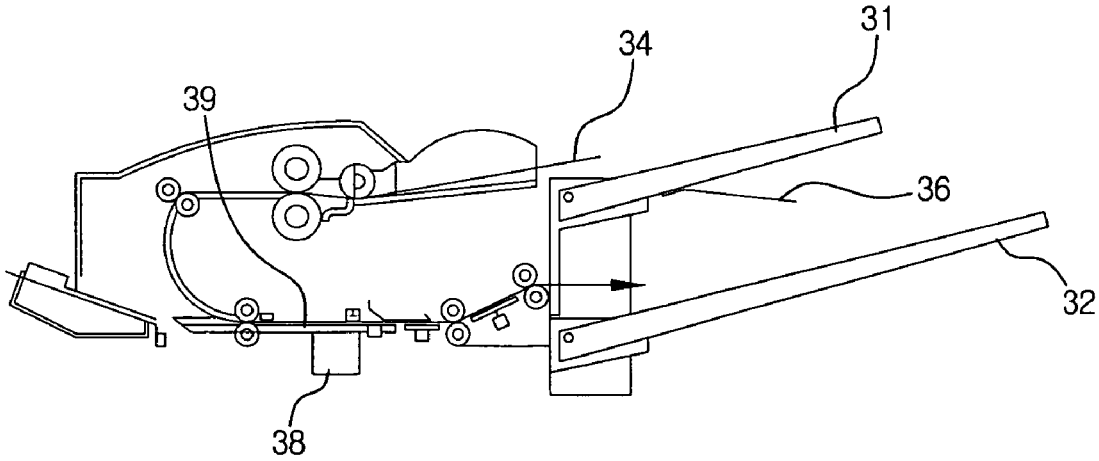
FIG. 2 (PRIOR ART)
FIG. 2 shows a document conveying device having another conventional anti-static device.
Figure 3:
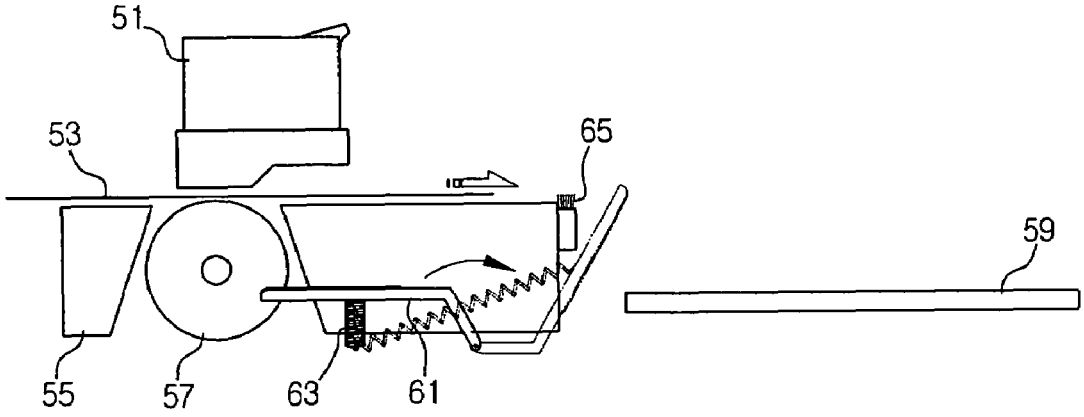
FIG. 3 (PRIOR ART)
FIG. 3 shows a document conveying device having another conventional anti-static device.

Hereinbelow, the embodiments of the present invention are described in detail with reference to accompanying drawings, wherein like reference numerals refer to the like elements throughout. The embodiments are described below in order to explain the present invention by referring to the figures.

Figure 4A:
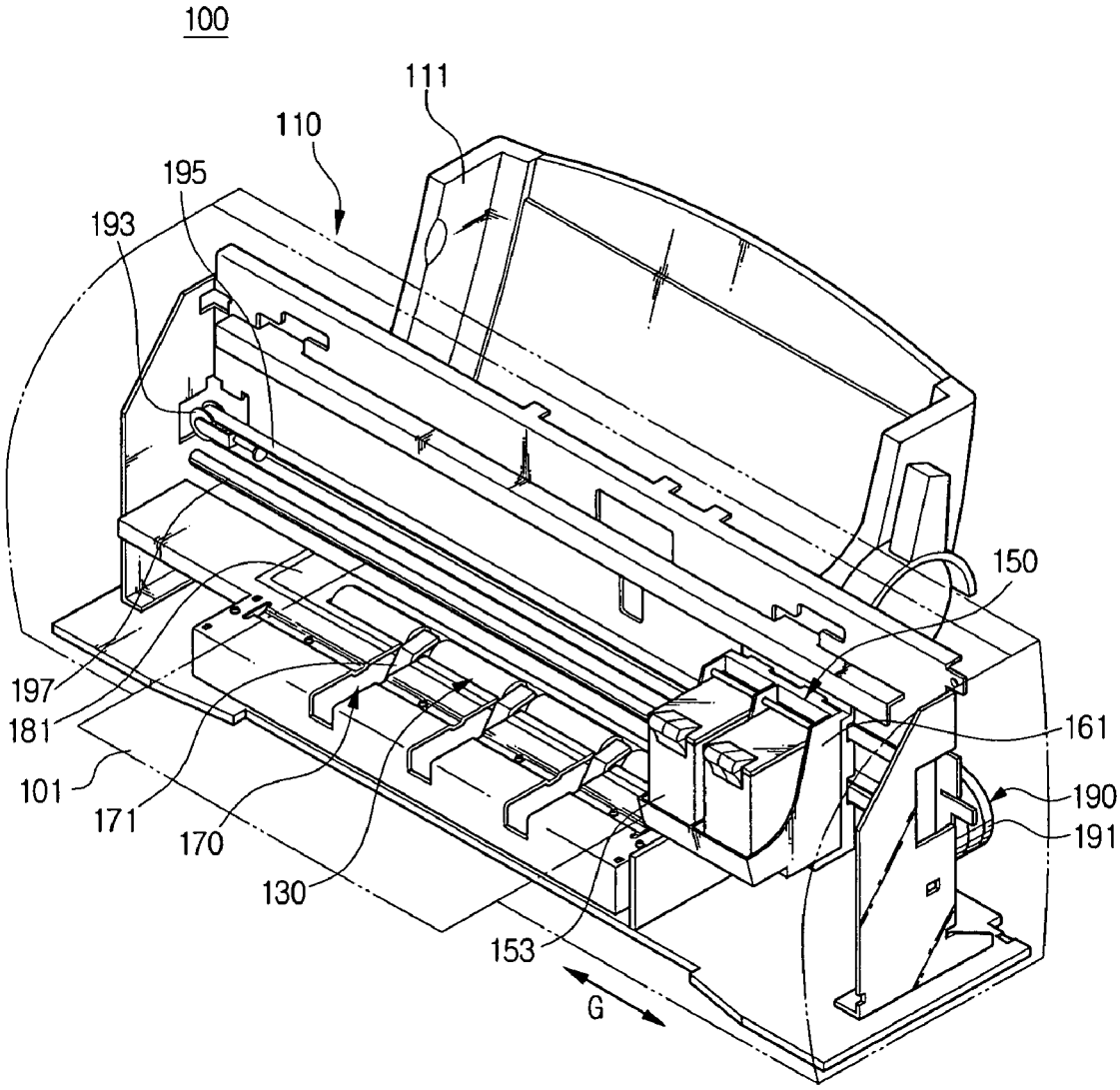
FIG. 4A schematically shows an ink-jet printer 100 provided with an anti-static structure according to an embodiment of the present invention.
Figure 4B:
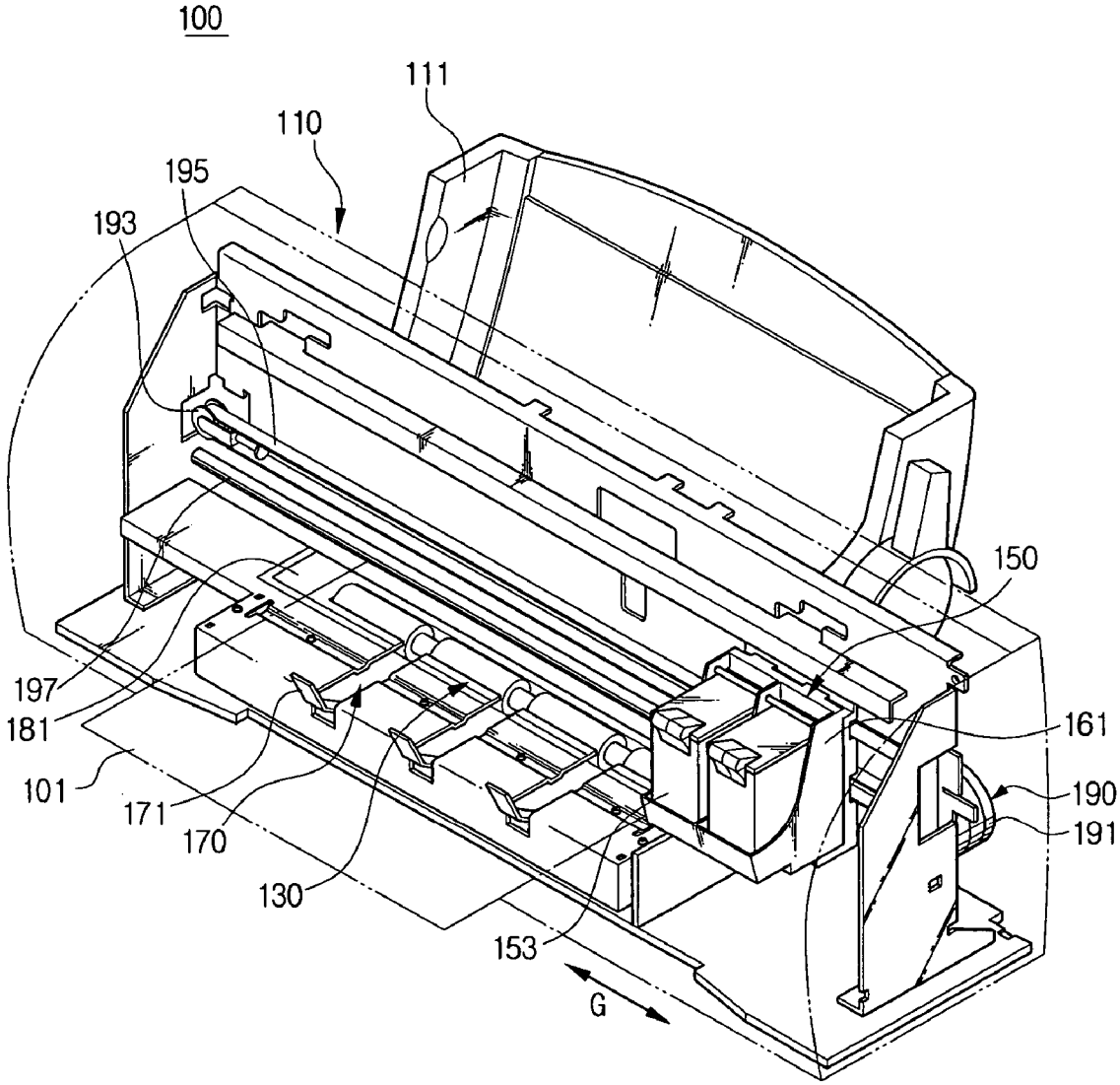
FIG. 4B shows a state of discharging a recording medium as the discharge pusher shown in FIG. 4A is operated.

FIG. 4A schematically shows an ink-jet printer 100 provided with an anti-static structure according to an embodiment of the present invention, and FIG. 4B shows a state of discharging a recording medium 101 as the discharge pusher shown in FIG. 4A is operated. Referring to FIGS. 4A and 4B, an ink-jet printer 100 comprises a recording medium supply unit 110 for supplying the recording medium 101. A feeding unit 130 feeds the recording medium 101 received from the recording medium supplying unit 110 into the printer 100. An image forming unit 150 prints an image on the recording medium 101 while the recording medium 101 is fed by the feeding unit 130. A recording medium discharge unit 170 discharges the recording medium 101 with the image printed by the image forming unit 150 to a discharge unit 185 (see FIGS. 5A and 5B). A driving unit 190 reciprocally moves the image forming unit 150.

The recording medium supply unit 110 comprises an automatic paper-feeding tray 111 for receiving recording medium 101, and a pickup roller (not shown) for transmitting the recording medium 101 received in the automatic paper-feeding tray 111 toward the feeding unit 130. However, it is understood that other feeding devices can be used and that manual feeding can be used instead of or in addition to the recording medium supply unit 110.

Figure 5A:
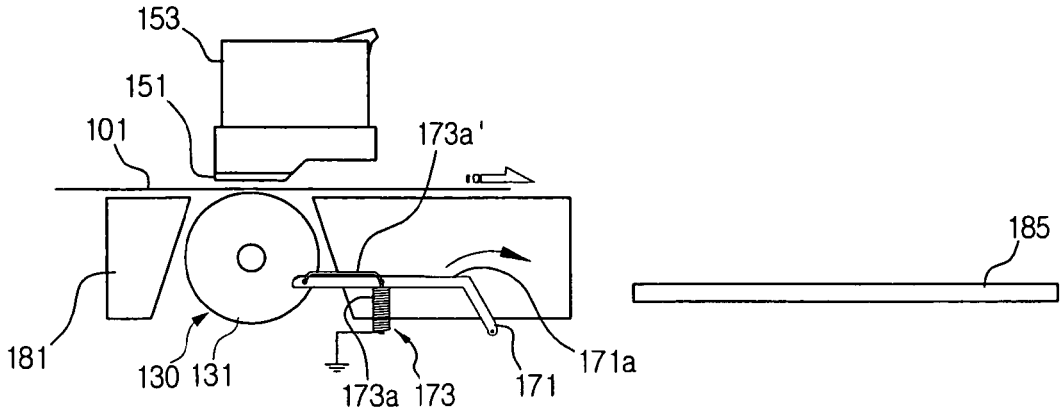
FIGS. 5A and 5B show the operating states of a recording medium discharge apparatus provided with an anti-static device according to an embodiment of the present invention.
Figure 5B:
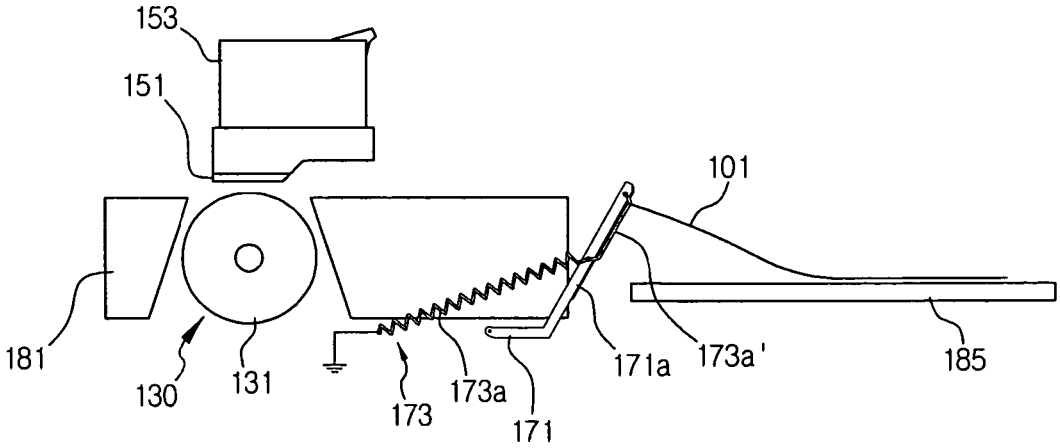

The image forming unit 150 comprises a cartridge 153. A print head 151 for injecting ink droplets is attached to the bottom of the cartridge 153 (as shown in FIGS. 5A and 5B). The cartridge 153 is mounted on a carriage 161 to be conveyed according to the movement of the carriage 161 in left and right directions (as indicated by arrow G), thereby forming an image on a recording medium 101 fed through the recording medium supply unit 110. However, it is understood that other image forming units 150 can be used using more or fewer cartridges and that the image forming unit 150 can be for laser and/or ink jet printing.

The driving unit 190 comprises a motor 101. A driving pulley (not shown) is connected to the motor 191. A driven pulley 193 is installed opposite to the driving pulley. A timing belt 195 is installed around peripheral surfaces of the driving pulley and the driven pulley 193. A guide rod 197 movably supports the carriage 161 along direction G. However, other driving arrangements can be used and need not be used in other aspects using other image forming units 150.

The recording medium discharge unit 170 comprises discharge pushers 171. The pushers 171 rotate by receiving power from a gear train (not shown in the drawings). As the power is transmitted through the gear train, the discharge pushers 171 rotate as shown in FIGS. 4B through 5B, thereby feeding the recording medium 101 formed with an image on the top side thereof. Upon completing the feeding movement, the discharge pushers 171 are returned to their original position by the restoring force of elastic members 173. While multiple pushers 171 are shown, it is understood that a single pusher 171 could be used.

FIGS. 5A and 5B show the operation of the recording medium discharge unit 170 with an anti-static device according to an embodiment of the present invention. Referring to FIGS. 5A and 5B, a platen 181 is provided under the print head 151. The recording medium 101 is seated on the platen 181 so that printing is performed on the top side of the recording medium 101. A feed roller 131 of the feeding unit 130 adjacent the platen 181 to convey the recording medium 101 to be printed with the image by a predetermined distance, and a discharge pusher 171 is installed in a side of the feed roller 131 to discharge the recording medium 101 to a discharge tray 185.

While shown discharging to the discharge tray 185, it is understood that the discharge can be any stacking or sorting area and need not be to a separate tray as shown, and the area need not be external to a housing if the stacking area is internal to the image forming unit 150. Moreover, it is understood that other discharge units 170 can be used which convey the recording medium 101 other than through pushing using the pushers 171.

The discharge pusher 171 is elastically supported by a coil spring 173*a*, which is an example of an elastic member 173. Upon completing the operation of discharging the recording medium 101, the discharge pusher 171 is returned to its original position by the restoring force of the coil spring 173*a*. As shown, the discharge pusher 171 is configured to perform an anti-static function according to an aspect of the invention. That is, at least one of the discharge pushers 171 is configured to eliminate static electricity produced by the friction of the recording medium 101, thereby preventing a stacking error caused when the recording medium 101 is stacked in the discharge tray 185 with static electricity. It is possible to configure the discharge pusher 171 so that the discharge pusher 171 itself performs a grounding function, to provide a separate ground member to perform the grounding function, or combinations thereof.

If the at least one discharge pusher 171 is configured so that the discharge pusher itself performs the grounding function, all or a portion of the discharge pusher 171 is formed from a conductive material (such as metal) and is connected to a ground according to an aspect of the invention. If a separate ground member is additionally provided to one or more of the discharge pushers 171, a conductive member is additionally provided on at least a portion of the surface 171*a* of the discharge pusher 171 and is connected to the ground.

FIGS. 5A and 5B show an example for providing a separate ground member and where the elastic member 173 implements the grounding function. The elastic member 173 a conductive coil member 173*a*. Here, one end 173*a*' of the coil spring 173*a* is projected on the recording medium contact surface 171*a* of the discharge pusher 171 to come into contact with the recording medium 101, thereby implementing an anti-static function.

The coil spring 173*a* is tensioned by the discharge pusher 171 rotated by the driving force provided for feeding the recording medium 101. If the discharge of the recording medium 101 is completed and the driving force exerted to the discharge pusher 171 is released, the coil spring 173*a* returns the discharge pusher 171 to the state shown in FIG. 5A by its restoring force. However, it is understood that other mechanisms can be used to bias the pusher 171 and that the spring 173*a* can be otherwise located.

While described as using the tension member 173 as a conductive grounding element, it is understood that additional ground paths can be created using a conductive hinge about which the pusher 171 rotates.

As described above, according to aspects of the present invention, it is possible to obtain an advantage of efficiently eliminating static electricity of a recording medium by forming a discharge pusher for discharging the recording medium from a conductive material or extending a coil spring for elastically supporting the discharge pusher to a surface which comes into contact with the recording medium, so that an anti-static function can be implemented until the recording medium is completely discharged to a discharge tray.

As the effect of eliminating static electricity is improved as described above, it is possible to prevent a stacking error caused by the repulsion or adhesion of a recording medium caused static electricity.

Moreover, if a coil spring is used to implement the anti-static function, the number of components can be reduced because it is not needed to use a separate anti-static device as in the prior art.

It is understood that the instant invention can be implemented in a wide variety of image forming devices, such as inkjet and laser printer devices, faxes, and copiers, and can be used in multifunction devices that further scan and/or fax in addition to forming images. Moreover, it is understood that aspects of the invention can be used in non-image forming devices in which paper or other media are automatically stacked, such as sorting and stacking machines, folding machines, and other like devices.

Although representative embodiments of the present invention have been shown and described in order to exemplify the principle of the present invention, the present invention is not limited to the specific embodiments. It will be understood that various modifications and changes can be made by one skilled in the art without departing from the spirit and scope of the invention as defined by the appended claims and equivalents thereof. Therefore, it shall be considered that such modifications, changes and equivalents thereof are all included within the scope of the present invention as defined in the claims.

What is claimed is:

1. A recording medium discharge apparatus comprising:

a discharge pusher for discharging a recording medium, on which static electricity has built up, directly from an image forming apparatus; and a discharge tray in which the recording medium discharged through the discharge pusher is stacked, wherein the discharge pusher conducts electric current to eliminate the static electricity from the recording medium discharged to the discharge tray by the discharge pusher.

2. The recording medium discharge apparatus as claimed in claim 1, wherein the discharge pusher comprises a conductive material to conduct the static electricity from the recording medium.

3. The recording medium discharge apparatus as claimed in claim 1, further comprising a conductive member provided on a surface of the discharge pusher which contacts the recording medium to conduct the static electricity from the recording medium.

4. The recording medium discharge apparatus as claimed in claim 3, wherein the discharge pusher is biased by a conductive spring connected to the conductive member of the discharge pusher to conduct the static electricity from the conductive member.

5. The recording medium discharge apparatus as claimed in claim 4, wherein the spring comprises a coil spring.

6. An image forming apparatus for use with a recording medium comprising:

a print head to form a given image on the recording medium;

a feed roller to feed the recording medium a predetermined distance a discharge tray in which the recording medium having the given image formed thereon is stacked; and a discharge pusher to discharge the recording medium having the given image formed thereon directly to the discharge tray and to conduct electric current to eliminate static electricity built up on the recording medium when the recording medium is discharged to the discharge tray.

7. The image forming apparatus as claimed in claim 6, wherein the discharge pusher comprises a conductive material to conduct the static electricity from the recording medium.

8. The image forming apparatus as claimed in claim 6, further comprising a conductive member on a surface of the discharge pusher which comes into contact with the recording medium to conduct the static electricity from the recording medium.

9. The image forming apparatus as claimed in claim 8, wherein the discharge pusher is biased by a conductive spring connected to the conductive member to conduct the static electricity from the recording medium.

10. The image forming apparatus as claimed in claim 9, wherein the spring comprises a coil spring.

11. A recording medium discharge apparatus comprising:

a movable discharge element which moves a recording medium, on which static electricity has built up, directly between first and second areas; and a conductive element on a surface of the movable discharge element, which removes the static electricity as the recording medium is moved between the first and second areas and which is arranged so as to be between the recording medium and the movable discharge element.

12. The recording medium discharge apparatus of claim 11, further comprising a ground element which connects the conductive element to a ground to form a conductive pathway between the recording medium and the ground via the conductive element.

13. The recording medium discharge apparatus of claim 12, wherein the ground element comprises a conductive biasing element which biases the movable discharge element in a direction.

14. The recording medium discharge apparatus of claim 11, wherein:

the second area is a tray, the first area is an image formation area where an image is formed on the recording medium, and the movable discharge element pushes the recording medium with the formed image from the image formation area to the tray.

15. The recording medium discharge apparatus of claim 11, wherein the movable discharge element rotates about an axis to push the recording medium from the first area to the second area.

16. A recording medium discharge apparatus comprising:

a movable discharge element which moves a recording medium, on which static electricity has built up, directly between first and second areas and rotates about an axis to push the recording medium from the first area to the second area; and a conductive element on a surface of the movable discharge element, which removes the static electricity as the recording medium is moved between the first and second areas and which is arranged so as to be between the recording medium and the movable discharge element which removes the static electricity as the recording medium is moved between the first and second areas; and a conductive biasing element which biases the movable discharge element to rotate in a direction while forming a conductive pathway between the recording medium being pushed and the ground via the conductive element.

17. The recording medium discharge apparatus of claim 16, wherein the second area is a tray, and the movable discharge element pushes the recording medium from the first area to the tray.

18. The recording medium discharge apparatus of claim 17, wherein:

the first area is an image formation area where an image is formed on the recording medium, and the movable discharge element pushes the recording medium with the formed image from the image formation area to the tray.

19. The recording medium discharge apparatus of claim 18, further comprising a feed roller which feeds the recording medium with the formed image to the movable discharge element to be pushed to the tray.

20. An inkjet printer including the recording medium discharge apparatus of claim 19 and further comprising an image forming unit which prints the image on the recording medium.

* * * * *

UNITED STATES PATENT AND TRADEMARK OFFICE

CERTIFICATE OF CORRECTION

PATENT NO. : 7,665,837 B2
APPLICATION NO. : 11/384502
DATED : February 23, 2010
INVENTOR(S) : Myung-bo Son It is certified that error appears in the above-identified patent and that said Letters Patent is hereby corrected as shown below:

Column 6, Line 6, change "distance" to --distance;--.

Signed and Sealed this

Third Day of August, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,665,837 B2
APPLICATION NO. : 11/384502
DATED : February 23, 2010
INVENTOR(S) : Myung-bo Son It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 758 days.

Signed and Sealed this

Twenty-eighth Day of December, 2010

David J. Kappos

David J. Kappos
*Director of the United States Patent and Trademark Office*